United States Patent [19]

Burgher et al.

[11] Patent Number: 4,584,551

[45] Date of Patent: Apr. 22, 1986

[54] TRANSFORMER HAVING BOW LOOP IN TUBULAR WINDING

[75] Inventors: Peter H. Burgher, Utica; John L. Boomer, Howell, both of Mich.

[73] Assignee: Marelco Power Systems, Howell, Mich.

[21] Appl. No.: 653,144

[22] Filed: Sep. 24, 1984

[51] Int. Cl.[4] ..... H01F 27/08

[52] U.S. Cl. ..... 336/61; 336/62; 336/96; 336/183

[58] Field of Search ..... 336/62, 183, 60, 234, 336/55, 57, 58, 212, 96

[56] References Cited

U.S. PATENT DOCUMENTS

| | | | |
|---|---|---|---|
| 646,500 | 4/1900 | Moody | 336/62 |
| 1,394,044 | 10/1921 | Stephens | 336/62 X |
| 1,449,206 | 3/1923 | Weed | 336/62 X |
| 1,471,096 | 10/1923 | Brand | 336/62 |
| 2,170,700 | 8/1939 | Von Henke | 336/62 |
| 2,817,066 | 12/1957 | Scanpa | 336/62 X |
| 3,074,009 | 1/1963 | Dunnabeck et al. | 336/62 X |
| 3,144,627 | 8/1964 | Dunnabeck et al. | 336/62 X |
| 3,503,026 | 3/1970 | Geisel et al. | 336/62 |
| 3,728,655 | 4/1973 | Reinke | 336/62 |

FOREIGN PATENT DOCUMENTS

| | | | |
|---|---|---|---|
| 2645536 | 4/1977 | Fed. Rep. of Germany | 336/62 |

OTHER PUBLICATIONS

Finke, "Miniature Laminated Cores of Improved Permeability for Low Frequency Transformers and Reactors," Wescom Technical Papers, Aug. 20–23, 1968, pp. 1–8.

*Primary Examiner*—Thomas J. Kozma
*Attorney, Agent, or Firm*—Gifford, VanOphem, Sheridan, Sprinkle & Nabozny

[57] ABSTRACT

A transformer comprising a core, a primary winding and a secondary winding in which one of the windings, preferably the winding with the least coils, is formed from a tubular member formed in a plurality of coils; in the preferred embodiment of a step down transformer, the secondary winding is formed from a tubular member. A connector block at each end of the secondary winding includes an appropriate fluid passage and means for connecting a fluid coupling to the block so that the inlet and outlet of the fluid circulation system can be secured to the tubular member forming the secondary winding. The loops of the primary coil are interdigitally arranged with the loops of the secondary coil so that the fluid in the secondary coil absorbs heat from both the primary and secondary windings. Each loop of the secondary includes a bow so that adjacent ends of each loop of the primary are sandwiched between the bows. Preferably, the core is made of laminated sections, each laminated section comprising a substantially E-shaped portion, the legs of each E-shaped portion abutting against the legs of the other E-shaped portion in each laminate layer. The primary and secondary coils are wrapped around the center leg of the core.

11 Claims, 5 Drawing Figures

TRANSFORMER HAVING BOW LOOP IN TUBULAR WINDING

BACKGROUND OF THE INVENTION

I. Field of the Present Invention

The present invention relates generally to electrical transformer apparatus having a primary winding, a secondary winding and a core, and more particularly, to such a device in which appropriate passages are formed so that a fluid coolant can be circulated through the device to remove heat from the transformer.

II. Description of the Prior Art

In a transformer in which the primary winding and secondary winding are coupled by a core of magnetic material, a large amount of heat can be generated during operation of the device. Often, the heat is dissipated by exposing the transformer in an open area so that the heat can be radiated away from the device. On the other hand, such a method of cooling the transformer is often insufficient to dissipate the large amount of heat from the transformer, especially when the transformer is enclosed within a machine housing. Accordingly, it becomes necessary to provide the device with supplemental cooling means in order to prevent malfunctioning and destruction of the transformer components.

One previously known means for cooling the transformer involves the use of cooling conduits wrapped around or through the device so that a cooling fluid can be circulated about the device to absorb the heat and release it at a point remote from the transformer. Alternatively, it may be possible to provide fluid passageways adjacent to the core in order to effect the cooling of the transformer. However, the cooling passages or conduits are often disposed apart from the windings of the transformer so that they do not interfere with the operation of the transformer. Thus, the heat is absorbed only after it has been conducted through a portion of the device and does not, therefore, eliminate areas of extremely high heat content at the windings where the heat may be generated. Accordingly, the windings may still be subjected to a large amount of heat and high temperature which can cause fatigue and destruction of the windings. Moreover, the addition of fluid conduits to a transformer increase the weight and complexity of the device and are, therefore, more costly to produce. In addition, when the cooling system is separately fabricated, additional time and labor is necessary to install the cooling system on the transformer, and therefore, further increases the cost and complexity of the device.

SUMMARY OF THE PRESENT INVENTION

The present invention overcomes the above mentioned disadvantages by providing a transformer in which at least one of the windings is formed from a tubular member through which a fluid coolant can be circulated. The tubular member is formed in a series of loops which are preferably spaced apart so that loops of the primary winding can be interspersed between loops of secondary windings. A fluid connector is secured to each end of the tubular member so that the tubular member can fluidly communicate with coolant circulation system such as a conduit system including a reservoir supplied with a fluid coolant. Preferably, the fluid connector also includes means for electrically connecting the winding to an appropriate electrical circuit.

In the preferred embodiment, the transformer generally comprises a laminated core having upper and lower body portions interconnected by a pair of outer legs and an inner leg spaced apart from the outer leg so as to define elongated channels extending through the core so that the primary and secondary windings can be wrapped around the center leg of the core. Preferably, both ends of the secondary winding extend outwardly from end of the core while both ends of the primary winding extend outwardly from opposite ends of the core. In addition, the loops of the secondary winding are interposed between the loops of the primary winding thus greatly improving magnetic coupling over standard methods. In addition, each loop of the primary winding comprises a separately wound section of wound conductor which is insulated from adjacent loops of the secondary winding and electrically connected to adjacent sections of the primary winding.

Also in the preferred embodiment, a connector block having a fluid passageway is connected to each end of the secondary winding so that the fluid passageway communicates with the passageway in the tubular member. Thus, the connecting block provides a means for connecting the secondary winding to a coolant circulation system so that fluid coolant can be provided to the transformer to cool the transformer. In addition, the connector block preferably includes means for electrically connecting the respective end of the secondary coil to an electrical circuit.

Thus, the present invention provides a transformer in which a fluid coolant flows through the member forming the secondary coil of the transformer and thus avoids the need for separate cooling conduit structures or fluid passageways in the core of the transformer to provide coolant for the transformer. In addition, the interposition of the loops in the primary winding in the secondary winding permit both windings to be cooled by the single winding formed from a tubular member. While only one of the windings need be formed from a tubular member, it is preferred to employ the tubular member in the winding having the least number of turns to minimize the weight and the size of the transformer. Thus, in a step up transformer, it is conceivable that the primary winding would be formed from a tubular member. In any event, the transformer is substantially lighter than previously known transformers utilizing a circulation system for fluid coolant, and is substantially less complex than previously known fluid cooled transformers. Accordingly, the transformer of the present invention is less expensive and easier to install than previously known fluid cooled transformers.

BRIEF DESCRIPTION OF THE DRAWING

The present invention will be more clearly understood by reference to the following detailed description of a preferred embodiment, when read in conjunction with the accompanying drawing in which.

DETAILED DESCRIPTION OF A PREFERRED EMBODIMENT OF THE PRESENT INVENTION

Figure 1:
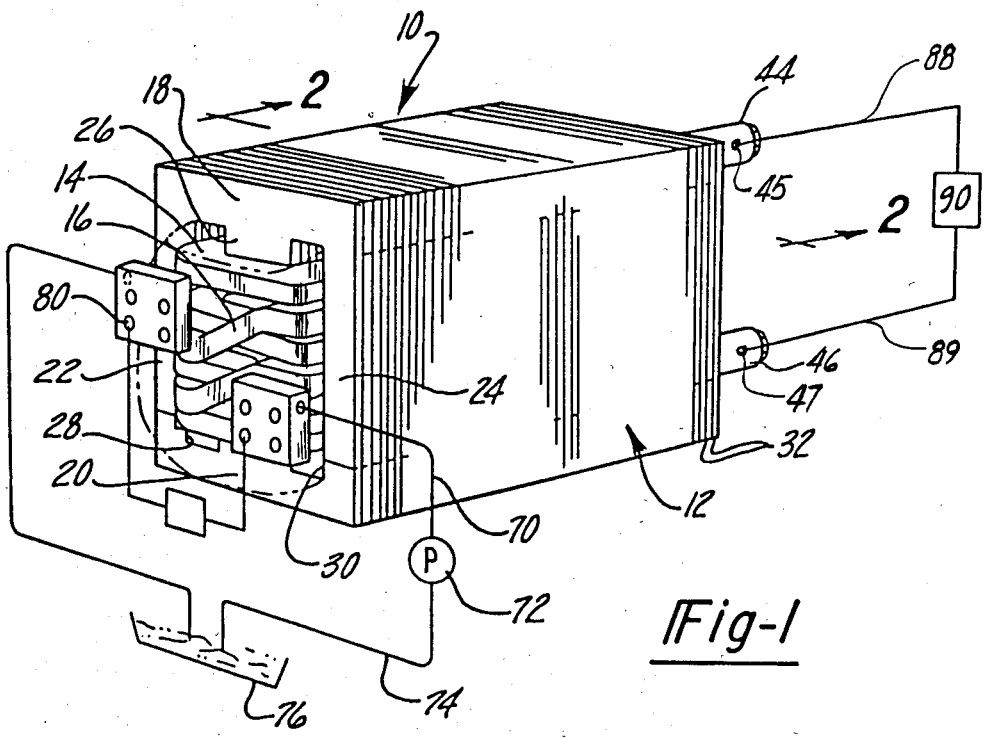
FIG. 1 is a perspective view of a transformer in accordance with the present invention.

Referring first to FIG. 1, the transformer 10 according to the present invention is thereshown comprising a core 12, a primary winding 14 and a secondary winding 16. The core 12 comprises an upper body portion 18 and a lower body portion 20 interconnected by outer legs 22 and 24 and a center leg 26. The outer legs 22 and 24 are spaced apart from the center leg 26 to define two separated channels 28 and 30 extending through the core 12. Thus, the primary winding 14 and the secondary winding 16 can be wrapped around the center leg 26 in a manner to be described in detail hereinafter.

Figure 2:
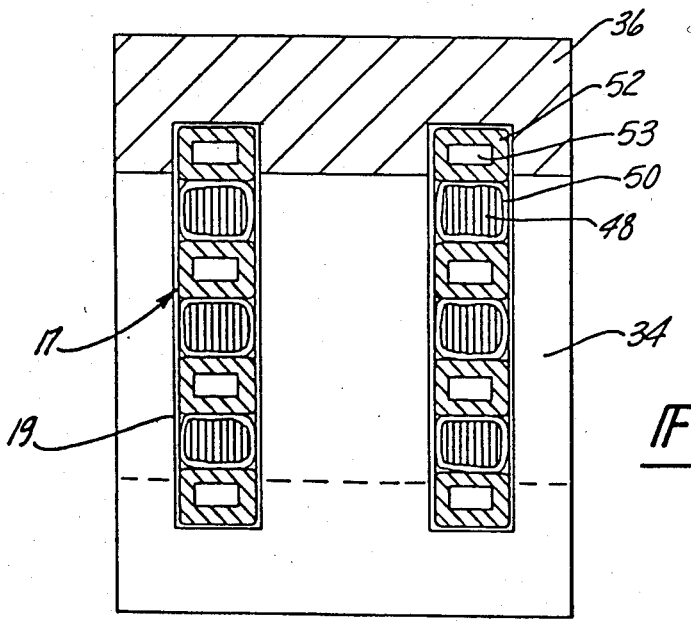
FIG. 2 is a sectional view taken substantially along line 2—2 in FIG. 1.
Figure 3:
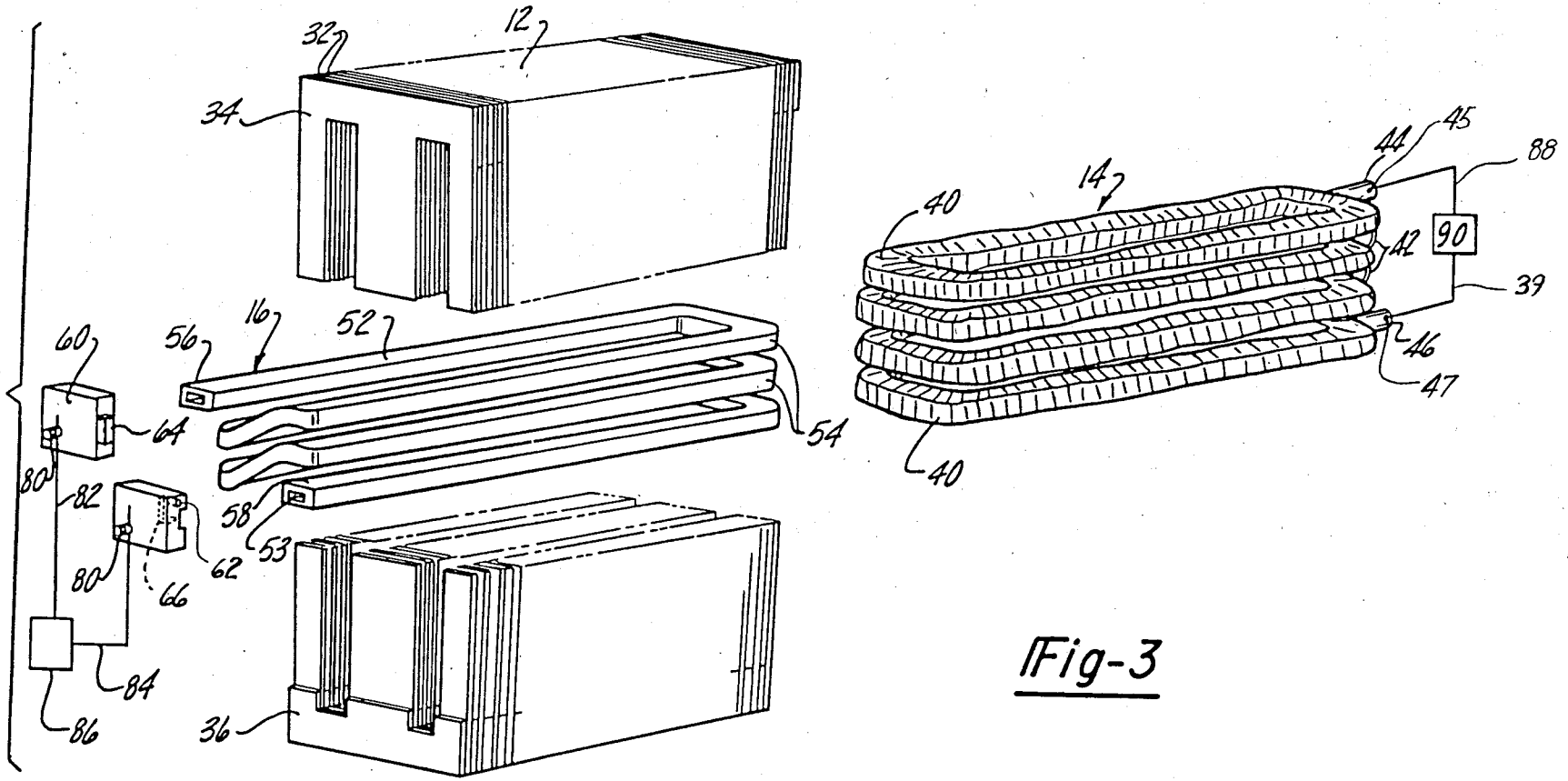
FIG. 3 is an exploded perspective view of the device shown in FIGS. 1 and 2.

Referring now to FIGS. 2 and 3, the core 12 is formed from a plurality of lamination layers 32, each layer comprising a substantially elongated E-shaped section 34 and a substantially shortened E-shaped section 36. The ends of the legs of each E-shaped section in each layer 32 abut against each other to thereby define an elongated slot portion of the channels 28 and 30. As can be seen in the Figures, sections 34 and 36 of one layer are reciprocally positioned in reverse order to the sections 34 and 36 of the adjacent layers 32 so that the butt ends of each layer do not coincide and are consistently overlapped by adjacent laminations to minimize flux losses in the core 12. The laminated construction of the core 12 likewise serves to eliminate flux losses in the core 12.

The primary winding 14 comprises a plurality of loop sections 40 electrically connected together by appropriate means such as an insulated electrical conductor wire 42. As best shown in FIG. 2, each primary loop 40 comprises a flat wire formed in numerous coils 48 and sealed in an encapsulating coating 50. The flat sides of the wire are aligned parallel to the axis of the coils as shown in FIG. 2. The coating 50 preferably comprises a dielectric tape wrapping which is impregnated with varnish in a vacuum and then baked to attain the desired insulation standards.

A primary lead wire extends from each of the top and bottom loops 40 and is attached to tubular lugs 44 and 46, respectively, so as to extend outwardly from the same end of the primary winding 14. The tubular lugs 44 and 46 includes a central threaded bore adapted to receive a set screw, and transverse bores 45 and 47, respectively, adapted to receive a wire conductor which is then locked into the lug by tightening the set screw. As shown in the drawing, wire conductors 88 and 89 are shown diagrammatically to wire conductors 88 and 89 are shown diagrammatically to connect a source circuit 90 to the lugs 44 and 46.

The secondary winding 16 comprises a tubular member 52 formed in a plurality of loops 54. The tubular member 52 defines a fluid passageway 53 throughout the length of the secondary coil 16. As shown in FIG. 3, elongated side portions of each loop 54 are spaced apart in a substantially planar arrangement while the tubular member 42 is angled at one end of a loop 54 to extend downwardly toward the loop at the next level. The loops 54 are spaced apart from ech other a predetermined distance which is substantially the same distance as and just slightly in excess of the width of the loops 40 in the primary winding. Preferably, both ends 56 and 58 of the secondary winding 16 extend outwardly from the same end of the top and bottom loops 54, respectively.

A connector block 60 is secured to each end 56 and 58 of the tubular member 52. Each connector block 60 includes means for connecting the block to an end of the tubular member 52 so that the fluid pasageway 53 fluidly communicates with a fluid coupling opening 62 in the block 60. For example, the block 60 includes a recess 64, the periphery of which sealingly engages the outer periphery of the tubular member 52, and which includes passageway 66 communicating with the recess 64 to align with the fluid passageway 53 in tubular member 52. The fluid passageway 66 terminates at and is open to the threaded opening 62 so that a correspondingly threaded standard fluid coupling (not shown) can be secured to the block 60 and in fluid communication with passageway 53.

As best shown in FIG. 1, a fluid line 70 extends from the aperture 62 in the block 60 to the outlet of pump 72 whose inlet is connected by an appropriate conduit 74 to a fluid supply means such as reservoir 76. A return line 78 is secured to the fluid coupling opening 62 of the block 60 connected at end 56 of the tubular member 52 and forms the return line to the reservoir 76. While the reservoir is used in the preferred embodiment to provide a means for cooling the fluid once it has circulated through the secondary coil 16, it will be understood that other types of heat exchangers can also be used and remain within the scope of the present invention.

In addition, each connector block 60 preferably includes means for electrically connecting the secondary winding 16 to an electrical circuit, for example, a circuit employed in a welding or other appropriate device. As best shown in FIGS. 1 and 3, a threaded aperture 80 in the block 60 threadedly receives a corresponding bolt (not shown) around which a wire conductor can be looped or a connecting lug can be affixed and sandwiched between the head of the bolt and the surface of the block 60. While other connector means, including means for securing a welding electrode holder to the block are also within the scope of the present invention, the embodiment shown on the drawing is perhaps the most inexpensive way for providing such a connection and is, therefore, considered most appropriate at the time of the invention. In any event, appropriate conductors 82 and 84, shown diagrammatically in FIGS. 1 and 3, connect the connector blocks 60 in an appropriate circuit 86, for example, connecting each block 60 to a cable which extends to an electrode of a welding gun. This invention is not limited to welding applications although it is clearly highly appropriate thereto.

When assembling the transformer 10 of the preferred embodiment of the present invention, the core is made in upper and lower portions, each portion comprising a plurality of elongated E-shaped plates 34 consecutively spaced apart by shortened plates 36 while the lower portion is correspondingly constructed with smaller E-shaped plates 36 spaced apart by elongated members 34 and in a reciprocal fashion as described above.

While each of the loops 40 of the primary winding 14 are wrapped with insulating material, each conductor 42 is of a sufficient length so that each loop 40 can be spaced apart from the next primary loop a predetermined distance substantially equal to the height of the tubular member 52 of the secondary winding 16. The loops 40 of the primary winding 14 are interdigitally positioned with respect to the loops 54 of the secondary coil 16 to form a winding subunit 17 in which adjacent loops abut against each other (FIG. 2). The subunit 17 is then wrapped in a sheet 19 (FIG. 2) of dielectric material and positioned in the lower portion of the core 12 so that the sides of the loops 54 and 40 rest in the lower portion of channels 28 and 30 of the core. Of course, the upper portion of the core is then interdigitally positioned on the bottom portion of the core to retain the primary and secondary coils in the channels 28 and 30. In the preferred embodiment, the exposed ends are covered or "potted" in an insulating material such as an epoxy.

Of course, the ends 56 and 58 of the secondary winding extend outwardly from one end of the core 12 and are secured within the recess 64 of the connector block 60 by an appropriate means such as welding or soldering. An appropriate threaded fluid coupling is then secured within the threaded opening 62 of each connector block 60 to connect the conduit lines 70 and 78 of the cooling system to the fluid passageway 53 in the secondary winding 16. It will be understood that the electrical connection means, such as the threaded apertures 80 in the connector blocks 60, remain exposed for connection to desired electrical apparatus and that the primary leads 44 and 46 remain exposed for electrical connection to a power source at the other end of transformer.

Figure 4:
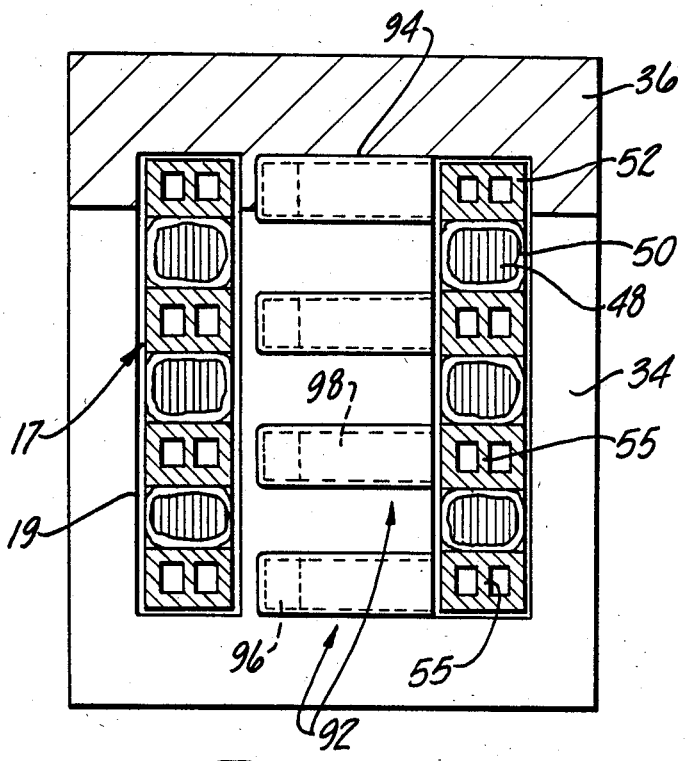
FIG. 4 is a sectional view similar to FIG. 2 but showing a modification thereof.
Figure 5:
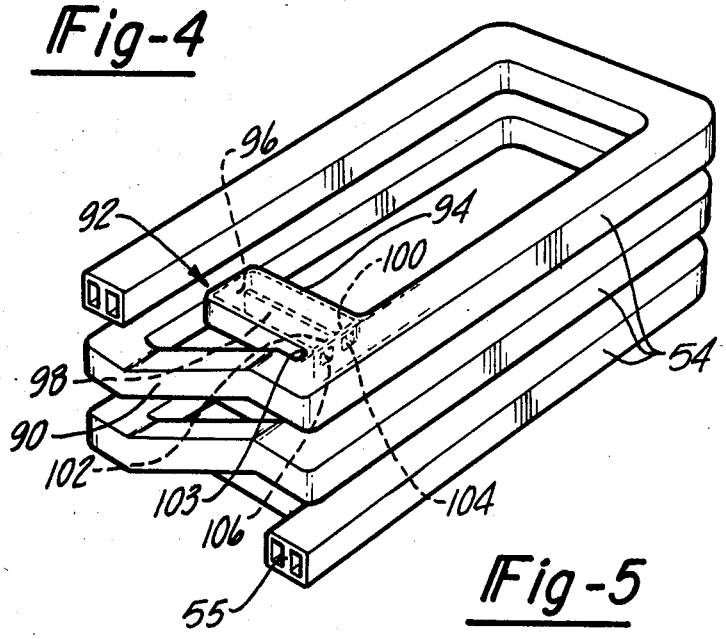
FIG. 5 is an enlarged fragmentary view of a portion of the device shown in FIG. 4.

Referring now to FIGS. 4 and 5, a further improvement of the transformer construction of the present invention comprises an ox bow loop in each loop of the tubular winding. As is evident in FIG. 3, end portions 90 of each loop 54 extend beyond a portion of the adjacent loop 40 to connect with the next loop 54. Thus, an end portion of each loop 40 is not juxtapositioned between loops of the tubular member 52 so that cooling fluid in the tubular member can carry away heat from that portion of winding 40. As a result, these hot spots can interfere with optimum efficiency and reduce the useful life of the transformer. The ox bow loop provides a fluid passage means for circulating fluid adjacent the exposed portion of loop 40 of the primary windings.

As best shown in FIG. 4, the fluid passage means extends substantially across the entire exposed end portion of loop 40. In the preferred construction of the ox bow loop 92, as shown in FIG. 5, a hollow housing 94 defining a cavity 96 includes an partition wall 98 dividing the open end of the cavity into an inlet 100 and an outlet 102. The housing is secured by welds 103 or the like to a portion of loop 54 upstream of the portion 90. So the inlet 100 and the outlet 102 are connected in fluid communication with registering apertures 104 and 106 in the tubular member forming loop 54.

The housing 94 could be simply constructed by a sharply curved tubular conduit of the same type used to form the tubular winding. Nevertheless, it will be understood that the ox bow loop further reduces the inefficiency and destruction resulting from heat build up in transformers, especially those used in high current applications such as welding processes. Moreover, when the tubular member 52 forming each loop 54 includes a partition wall 54 defining inner and outer fluid passageways, only one of the fluid passageways need be diverted into the ox bow loop 92 in accordance with the present invention.

Thus, it can be seen that the transformer can be mounted within a machine housing without the installation of complex cooling apparatus for the transformer. Since the loops of the secondary coil are interposed between the loops of the primary coil, the primary winding as well as the secondary winding is cooled by the flow of fluid through the tubular member forming the secondary winding. Since the heat is absorbed from within the secondary winding itself, the heat is more effectively dissipated from the transformer than with previously known water cooled transformers which employ external conduits or fluid passageways in the core to dissipate heat from the transformer. Moreover, since the fluid passageways are incorporated in the member forming the secondary winding, the device is substantially lighter and less complex than previously known water cooled transformers. The transformer is also rendered lighter than previously known transformers because of the improved physical and magnetic coupling between the primary and secondary windings. The physical coupling provides greater magnetic coupling between the windings and results in a more efficient transformer because flux losses which could limit the power output of the transformer are reduced. The physical coupling provides more efficient heat exchange from the windings than previously known cooling systems for transformers, and the compact arrangement reduces total aggregate material bulk of the transformer.

Having thus described my invention, many modifications thereto will become apparent to those skilled in the art to which it pertains without departing from the scope and spirit of the present invention as defined in the appended claims.

What is claimed is:

1. A transformer comprising:

a core, a first winding having a plurality of first loops in said core, a secondary winding having a plurality of second loops in said core, said second loops being consecutively interpositioned between said first loops so that one end of each loop of said first winding terminates short of an adjacent end of each loop of said seconary winding, said second winding comprising a tubular conduit, said conduit forming a fluid passageway, means for passing a fluid conduit through said fluid passageway, and wherein said second winding incudes a bow adjacent said end of each loop of said second winding so that the adjacent ends of each loop of the first winding are sandwiched in between said bows.

2. The invention as defined in claim 1 wherein said first winding comprises a plurality of flat coils.

3. The invention as defined in claim 2 wherein the plane of each flat coil is substantially perpendicular to the axis of the loops of said second winding.

4. The invention as defined in claim 1 wherein both ends of said conduit extend outwardly from one end of said core.

5. The invention as defined in claim 1 and further comprising a fluid coupling means secured at said ends of said conduit for coupling said fluid passageway to a fluid conduit means.

6. The invention as defined in claim 5 wherein said fluid coupling means includes means for securing said conduit to an electrical conductor.

7. The invention as defined in claim 1 wherein said core comprises upper and lower body portions connected by two outer legs and a center leg, said legs being spaced apart to define a pair of spaced apertures through said core and wherein said loops wrap around said central leg of said core.

8. The invention as defined in claim 7 wherein said core comprises a plurality of laminations.

9. The invention as defined in claim 8 wherein each lamination comprises an elongated E-shaped section and a shortened E-shaped section.

10. The invention as defined in claim 9 wherein each lamination is placed in a reciprocal fashion with respect to each adjacent lamination.

11. The invention as defined in claim 1 wherein said core is encapsulated in an dielectric material about the ends of the windings so that only electrically conductive terminals of the windings remain exposed from the ends of the transformer.

* * * * *